US009703226B2

(12) United States Patent
Kuroda

(10) Patent No.: US 9,703,226 B2
(45) Date of Patent: Jul. 11, 2017

(54) CHARGING MEMBER

(71) Applicant: SAMSUNG ELECTRONICS CO., LTD., Suwon-si, Gyeonggi-do (KR)

(72) Inventor: Noriaki Kuroda, Yokohama (JP)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/157,719

(22) Filed: May 18, 2016

(65) Prior Publication Data

US 2016/0266511 A1 Sep. 15, 2016

Related U.S. Application Data

(63) Continuation of application No. PCT/KR2014/011239, filed on Nov. 21, 2014.

(30) Foreign Application Priority Data

Nov. 21, 2013 (JP) ..... 2013-240946
Sep. 3, 2014 (JP) ..... 2014-179346

(51) Int. Cl.
*G03G 15/02* (2006.01)

(52) U.S. Cl.
CPC ..... *G03G 15/0233* (2013.01)

(58) Field of Classification Search
CPC ..... G03G 15/0233; G03G 15/0216; G03G 2215/021
USPC ..... 399/176
See application file for complete search history.

(56) References Cited

U.S. PATENT DOCUMENTS 6,962,746 B2 11/2005 Taniguchi et al.
7,366,448 B2 4/2008 Taniguchi et al.
7,835,669 B2 11/2010 Furukawa et al.
8,376,922 B2 2/2013 Akama et al.
2010/0142998 A1* 6/2010 Furukawa ..... G03G 15/0233 399/176

(Continued)

FOREIGN PATENT DOCUMENTS

EP 2 071 412 A1 6/2009
JP 2003-316111 11/2003

(Continued)

OTHER PUBLICATIONS

Machine translation of JP 2010-181819 printed on Jan. 27, 2017.*

(Continued)

*Primary Examiner* — Sophia S Chen
(74) *Attorney, Agent, or Firm* — Staas & Halsey LLP

(57) ABSTRACT

A charging member, one embodiment of which includes a conductive support; a conductive elastomer layer stacked on the conductive support; and a conductive resin layer stacked on the conductive elastomer layer, wherein the conductive resin layer includes: a matrix material; and a plurality of particles dispersed in the matrix material, wherein the particles include first particles, and when a thickness of a portion formed of the matrix material alone of the conductive resin layer is referred to as A [μm], an average particle size of the first particles is referred to as $B_1$ [μm], and an interparticle distance of the particles is referred to as Sm [μm], then A is in a range of 1.0 μm to 7.0 μm, $B_1/A$ is in a range of 5.0 to 30.0, and Sm is in a range of 50 μm to 400 μm.

21 Claims, 5 Drawing Sheets

(56) References Cited

U.S. PATENT DOCUMENTS

| | | | | |
|---|---|---|---|---|
| 2013/0170860 | A1* | 7/2013 | Martinkovic | G03G 15/0233 399/176 |
| 2013/0295330 | A1* | 11/2013 | Kodama | G03G 15/0233 399/176 |
| 2014/0334843 | A1* | 11/2014 | Taniguchi | G03G 15/0233 399/176 |
| 2015/0087489 | A1* | 3/2015 | Sato | G03G 15/0233 399/176 |
| 2015/0301469 | A1* | 10/2015 | Aoyama | G03G 15/0233 399/176 |

FOREIGN PATENT DOCUMENTS

| | | |
|---|---|---|
| JP | 2004-240357 | 8/2004 |
| JP | 2005-309398 | 11/2005 |
| JP | 2007-65469 | 3/2007 |
| JP | 2007-101864 | 4/2007 |
| JP | 2008-292830 | 12/2008 |
| JP | 2009-156906 | 7/2009 |
| JP | 2010-134452 | 6/2010 |
| JP | 2010-181819 | 8/2010 |
| JP | 2012-181226 | 9/2012 |
| KR | 10-2004-0021504 | 3/2004 |
| KR | 10-2006-0049278 | 5/2006 |
| WO | WO 2010/050616 A1 | 5/2010 |

OTHER PUBLICATIONS

International Search Report issued Feb. 25, 2015 in related International Patent Application No. PCT/KR2014/011239.
International Search Report mailed Feb. 25, 2015, in corresponding International Application No. PCT/KR2014/011239.

* cited by examiner

Crown Amount = D2 − (D1+D3)/2

CHARGING MEMBER

CROSS-REFERENCE TO RELATED APPLICATIONS

This application is a continuation application filed under 35 U.S.C. §111(a), of International Application PCT/KR2014/011239, filed Nov. 21, 2014, and claims foreign priority benefit to Japanese Patent Application No. 2013-240946, filed Nov. 21, 2013, and Japanese Patent Application No. 2014-179346, filed Sep. 3, 2014, the contents of which are incorporated herein by reference.

TECHNICAL FIELD

The inventive concept relates to a charging member, and more particularly, to a charging member that charges an image carrier (e.g., a photoconductor) that is used in an electrostatic latent image process applied to an electrophotographic image forming device.

BACKGROUND ART

Conventionally, "an alternating current (AC) charging technique" that applies a voltage of a direct current (DC) voltage component overlapped with an AC voltage component to a contact charging member has been used in order to improve charging evenness. However, since it is needed to use a high AC voltage having a peak-to-peak voltage that is twice or greater a discharge start voltage (Vth) of a DC voltage to be applied, a separate AC power supply, in addition to a DC power supply, is needed, which results in an increase in a cost of the device itself. Also, a large amount of close proximity discharging may occur between the charging member (e.g., a charging roller) and a photoconductor, and thus the durability of the charging roller or the photoconductor may deteriorate. In particular, the photoconductor may be easily abrased. The problem may be reduced by charging the charging roller by applying a DC voltage alone. For example, JP 2007-065469 A discloses a charging member that is used when charging is performed by applying a DC voltage alone thereto.

DETAILED DESCRIPTION OF THE INVENTIVE CONCEPT

Technical Problem

However, when only a direct current voltage is applied to the charging member, a discharge area becomes narrow, which makes it difficult to allow a photoconductor to maintain a stable potential. In this regard, uneven charging may easily occur when a toner or an external additive contaminates a surface of the charging member. Also, particles may drop out from the charging member. As a result, designing a charging member having a long lifespan may be difficult. Therefore, the present disclosure provides a charging member that may maintain stable charging properties for a long time even when only a direct current voltage is applied thereto.

Technical Solution

According to an aspect of the inventive concept, there is provided a charging member that may maintain stable charging properties for a long time by appropriately controlling a thickness of the outermost layer (generally, a conductive resin layer) of the charging member, a size of particles in the outermost layer, and a distance between the particles in the outermost layer.

According to another aspect of the inventive concept, there is provided a charging member including a conductive support; a conductive elastomer layer stacked on the conductive support; and a conductive resin layer stacked on the conductive elastomer layer, wherein the conductive resin layer includes a matrix material; and a plurality of particles dispersed in the matrix material, wherein, the particles comprise first particles, and when a thickness of a portion formed of the matrix material alone of the conductive resin layer is referred to as A [μm], an average particle size of the first particles is referred to as B [μm], and an interparticle distance of the particles is referred to as Sm [μm], then A is in a range of about 1.0 μm to about 7.0 μm, $B_1/A$ is in a range of about 5.0 to about 30.0, and Sm is in a range of about 50 μm to about 400 μm.

In some embodiments of the present disclosure, the charging member may maintain stable charging characteristics for a long time even when only a direct current is applied.

A 10-point average roughness (RzJIS) of the conductive resin layer may be in a range of about 10.0 μm to about 35.0 μm. In this regard, stable charging characteristics may be easily maintained.

A content of the particles may be in a range of about 5 wt % to about 50 wt % based on the total weight of the conductive resin layer. In this regard, stable charging characteristics may be easily maintained.

$B_1$ may be in a range of about 5.0 μm to about 50.0 μm. In this regard, stable charging characteristics may be easily maintained.

The particles may further include second particles, and when an average particle size of the second particles is referred to as $B_2$ [μm], $B_1$ may be in a range of about 15.0 μm to about 40.0 μm, and $B_1$-$B_2$ may be about 10.0 μm or greater. In this case, a potential difference at a surface of a photoconductor caused by a difference in discharging statuses at a protruding end of each of the particles may be reduced, and thus improvement regarding fogging may be manifested.

The particles may be insulating particles. The particles may be irregular-shaped particles. The particles may be resin particles. Also, when the particles are resin particles, the resin particles may be at least one type of particles selected from the group consisting of nylon-based particles and acryl-based particles. The particles have good affinity with a matrix material, which may increase an adhesion strength at an interface with the matrix material and the resin particles, and thus durability of the charging member may further improve.

The matrix material may contain at least one selected from the group consisting of a nylon resin and a urethane resin. The material has good affinity with resin particles, which may increase an adhesion strength at an interface with the matrix material and the resin particles, and thus durability of the charging member may further improve.

The conductive elastomer layer may include epichlorohydrin rubber. In this regard, defects caused by resistance change during the production may decrease, and thus productivity may further improve. Also, an adhesive strength between the conductive elastomer layer and the conductive resin layer may further improve.

An AskerC hardness of the charging member may be 78±4. In this regard, when a load is applied, a contacting status between the charging member and the photoconductor may improve.

When a load applied to an end part of the conductive support is in a range of about 5.0 N to about 8.0 N, the charging member may have a crown amount in a range of about 60 μm to about 120 μm. In this regard, a contacting status between the charging member and the photoconductor or their driving statuses may be further stabilized.

When an electrical resistance value of the charging member, which is measured by using a metal roll electrode method, is referred to as R, a log R value may be about 5.4±0.4. In this regard, an optimum charging status of the charging member may be maintained.

Only a direct current voltage may be applied to the charging member, and a bias voltage applied thereto may be in a range of about −1000 V to about −1500 V. In this regard, a stable charging potential may be formed during an image printing process under various environment.

According to another aspect of the inventive concept, there is provided an electrophotographic image forming device that includes a main body; an image carrier; and a charging member for charging the image carrier, wherein the charging member is one of embodiments of a charging member provided according to an aspect of the present disclosure.

Advantageous Effects of the Invention

According to one or more embodiments of the present disclosure, provided is a charging member that may maintain stable charging properties for a long time even when only a direct current voltage is applied. That is, an image forming device including the charging member of the present disclosure can produce excellent images, while i) the image roughness, ii) the initial image defects (horizontal lines caused by uneven charging), and iii) the image defects that may be caused by particles dropped-out during a durability test are sufficiently suppressed, even when the device is driven for a long time.

Also, according to one or more embodiments of the present disclosure, since a conductive resin layer is formed as a sufficiently thin film, an electrostatic capacity may increase and a charging ability may improve. Also, in some embodiments of the present disclosure, an uneven surface may be formed on the conductive resin layer by using resin particles or inorganic particles, and thus discharge points may be sufficiently secured. Further, in some embodiments of the present disclosure, particle drop-out is sufficiently suppressed, and thus a charging member may have excellent durability.

BEST MODE

Figure 1:
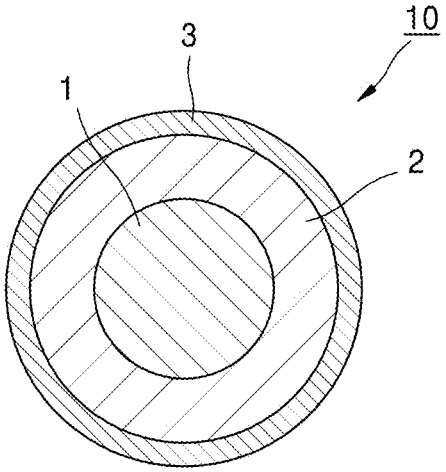
FIG. 1 is a schematic cross-sectional view of one embodiment of a charging member according to one aspect of the present disclosure.

Hereinafter, the inventive concept will be described in detail by explaining preferred embodiments of the inventive concept with reference to the attached drawings. Like reference numerals in the drawings denote like elements. Unless particularly stated otherwise, a location relation such as up, down, left, or right follows the location relation shown in the drawings. Also, size ratios are not limited to those shown in the drawings.

<Charging Member>

A charging member 10 according to an embodiment of the inventive concept includes a conductive support 1, a conductive elastomer layer 2 stacked on the conductive support, and a conductive resin layer 3 stacked as the outermost layer on the conductive elastomer layer 2. FIG. 1 is a schematic cross-sectional view of the charging member 10 according to the present embodiment. As shown in FIG. 1, the charging member 10 has the conductive elastomer layer 2 and the conductive resin layer 3 that are integrally stacked in this order, from the inside to the outside in a direction of a roll diameter, on an outer surface of the conductive support (an axis body) 1. Although not shown in FIG. 1 which is only a schematic view, an interlayer such as, for example, a resistance control layer for increasing voltage resistance (leakage resistance) may also be further disposed between the conductive elastomer layer 2 and the conductive resin layer 3.

In a general image forming device, the charging member 10 as shown in FIG. 1, may be included as a charging means which serves to charge an object to be charged. In particular, the charging member 10 may function as a means that evenly charges a surface of a photoconductor, which is an image carrier.

Conductive Support

Any metal having an electrical conductivity may be used as a conductive support, and the metal may be, for example, a metallic hollow body (a pipe type) or solid body (a rod type) formed of iron, copper, aluminum, nickel, or stainless steel. The outer surface of the conductive support may be subjected to a plating process, to a degree that would not degrade the conductivity, so as to impart the corrosion- or wear-resistance to the outer surface. Also, according to need, an adhesive or a primer may be coated on the same outer surface to increase an adhesive property with a conductive elastomer layer. In this case, in order to secure sufficient conductivity, the adhesive or primer may be treated to have an electrical conductivity according to need. The conductive support may have an external diameter in a range of, for example, about 5 mm to about 10 mm, and a length in a range of about 250 mm to about 360 mm.

Conductive Elastomer Layer

Any material that has appropriate elasticity for securing the intimate contact with a photoconductor may be used in the conductive elastomer layer. For example, the conductive elastomer layer may be formed by using: a natural rubber; a synthetic rubber such as an ethylene propylene diene rubber (EPDM), a styrene butadiene rubber (SBR), a silicon rubber, a polyurethane-based elastomer, an epichlorohydrin rubber, an isoprene rubber (IR), a butadiene rubber (BR), an acrylonitrile-butadiene rubber (NBR), a hydrogenated NBR (H-NBR), or a chloroprene rubber (CR); or a synthetic resin such as a polyamide resin, a polyurethane resin, or a silicon resin; as a base polymer. The materials may be used alone or as a combination of at least two selected therefrom.

A common additive such as a conducting agent, a vulcanizing agent, a vulcanizing accelerator, a lubricant, or a processing-aid agent may be appropriately added to the base polymer in order to give desired characteristics to the conductive elastomer layer. However, in terms of forming a stable electrical-resistance, the conductive elastomer layer may include an epichlorohydrin rubber as a main ingredient. In particular, the conductive elastomer layer may include an epichlorohydrin rubber in an amount of 50.0 wt % or more, or, for example, may include an epichlorohydrin rubber in an amount of 80.0 wt % or more.

Also, examples of the conducting agent may include carbon black, graphite, potassium titanate, iron oxide, conductive titanium oxide (c-$TiO_2$), conductive zinc oxide (c-ZnO), conductive tin oxide (c-$SnO_2$), and a quaternary ammonium salt. Examples of the vulcanizing agent may include sulfur. Examples of the vulcanizing accelerator may include tetramethyl thiuram disulfide (CZ). Examples of the lubricant may include stearic acid. Examples of the processing-aid agent may include zinc oxide (ZnO).

A thickness of the conductive elastomer layer may be in a range of about 1.25 mm to about 3.00 mm for appropriate elasticity.

Conductive Resin Layer

Figure 2:
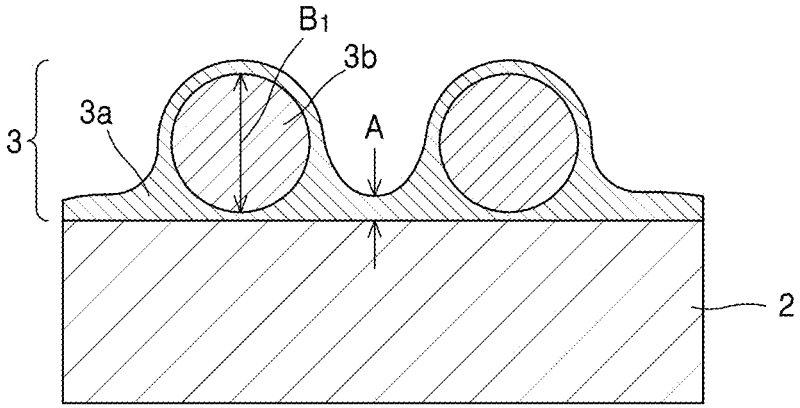
FIG. 2 is an enlarged schematic cross-sectional view of a surface of a conductive resin layer of one embodiment of the charging member according to one aspect of the present disclosure.

The conductive resin layer includes a matrix material and at least one type of particles selected from the group consisting of resin particles and inorganic particles. In an embodiment, the particles include first particles. FIG. 2 is an enlarged schematic cross-sectional view of a surface of a conductive resin layer 3 of the charging member according to an embodiment. As shown in FIG. 2, the conductive resin layer 3 includes a matrix material 3*a* and a plurality of first particles 3*b* that comprise at least one type selected from the group consisting of resin particle and inorganic particles, and the first particles 3*b* are dispersed in the matrix material 3*a*.

Any material that does not contaminate a photoconductor, which is an object to be charged, may be used as the matrix material. For example, the matrix material may include, as a base polymer, a fluorine resin, a polyamide resin, an acryl resin, a nylon resin, a polyurethane resin, a silicon resin, a butyral resin, a styrene-ethylene•butylene-olefin copolymer (SEBC), or an olefin-ethylene•butylene-olefin copolymer (CEBC). These may be used alone or as a combination of at least two selected therefrom. In some embodiments, in terms of easiness of handling or a degree of freedom for material design, the matrix material 3*a* may be selected from the group consisting of a fluorine resin, an acryl resin, a nylon resin, a polyurethane resin, and a silicon resin, or, for example, the matrix material 3*a* may be at least one selected from the group consisting of a nylon resin and a polyurethane resin.

Here, a thickness of the conductive resin layer, that is, a thickness of a part formed of the matrix material alone (a thickness of a layer; a thickness of a part indicated by "A" in FIG. 2) may be in a range of about 1.0 μm to about 7.0 μm. In particularly, a thickness of the conductive resin layer is a thickness at the midpoint between the most closely adjacent particles. When the thickness is about 1.0 μm or greater, the added resin particles and/or inorganic particles may be continuedly maintained without dropping out for a long time, and, when the thickness is about 7.0 μm or less, good charging performance may be maintained. In this regard, the thickness of the conductive resin layer may be in a range of about 1.0 μm to about 5.0 μm, or, for example, in a range of about 2.0 μm to about 4.0 μm. Also, the thickness of the conductive resin layer may be measured by observing through an optical microscope or an electron microscope a cross-section of a roller which has been cut with a sharp blade.

The particles may be any material that may form an uneven surface of the conductive resin layer to sufficiently secure discharge points. Examples of the resin particles may include a urethane resin, a polyamide resin, a fluorine resin, a nylon resin, an acryl resin, and a urea resin. An appropriate material for the inorganic particles may be silica or alumina. These may be used alone or as a combination of at least two selected therefrom. In an embodiment, in terms of compatibility with the matrix material, dispersionmaintaining property after adding the particles, and stability after coating (a pot life), the material of the particles may be at least one type selected from the group consisting of nylon resin particles, acryl resin particles, and polyamide resin particles, or, for example, at least one type selected from the group consisting of nylon resin particles and acryl resin particles. Also, as exemplified above, the particles may be insulating particles.

In an embodiment, an average particle size of the first particles may be in a range of about 5.0 μm to about 50.0 μm (part "$B_1$" of FIG. 2) in terms of suppressing charging unevenness, which indicates initial image defects. In the same regard, an average particle size of the first particles may be, for example, in a range of about 15.0 μm to about 30.0 μm. Also, the average particle size of the particles may be obtained by randomly selecting 100 particles from a group of a plurality of particles from scanning electron microscope observation and calculating an average value of the sizes of the particles. However, when a particle diameter is not consistent as such in the case of particles having a shape of an oval (of which a cross-sectional shape is an oval) or an irregular shape, not a complete sphere, a simple average value of the longest diameter and the shortest diameter is determined as a particle size of the particles.

A distance between the particles (i.e., a distance between particles including the first particles and, if present, the second particles) may be in a range of about 50 μm to about 400 μm. When the distance between the particles is about 50 μm or greater, roughness and particle drop-out on a surface of the conductive resin layer may be suppressed. Also, when the distance is about 400 μm or less, particle drop-out may be suppressed. In the same regard, a distance between the particles may be in a range of about 75 μm to about 300 μm, or, for example, in a range of about 100 μm to about 250 μm. Also, the distance between the particles may be measured based on JIS B0601-1994.

In an embodiment, when a thickness of the conductive resin layer is referred to as A [μm], an average particle size of the first particles is referred to as $B_1$ [μm], and an interparticle distance of the particles is referred to as Sm [μm], then A is in a range of about 1.0 μm to about 7.0 μm, $B_1/A$ is in a range of about 5.0 to about 30.0, and Sm is in a range of about 50 μm to about 400 μm. Here, when $B_1/A$ is about 5.0 or greater, charging evenness may be sufficiently secured, and when $B_1/A$ is about 30.0 or less, castability of a coating solution for forming a conductive resin layer may improve and particle drop-out may be suppressed. In the same regard, $B_1/A$ may be in a range of about 7.5 to about 20.0, or, for example, in a range of about 8.0 to about 12.5.

A particle content may be in a range of about 5 wt % to about 50 wt % based on the total weight of the conductive resin layer. When the content is about 5 wt % or higher, charging performance may be easily satisfied, and when the content is about 50 wt % or lower, particle sedimentation may be easily controlled when the particles are coated and coating stability may not be deteriorated. In the same regard, the content may be in a range of about 10 wt % to about 40 wt %, or, for example, in a range of about 20 wt % to about 30 wt %. Also, when the particles include the second particles, which will be described later in the present specification, in terms of exhibiting further improved charging performance, a content ratio of the first particles and the second particles may be in a range of about 5:1 to about 1:5, or, for example, in a range of about 3:1 to about 1:3. The particle content included in the conductive resin layer may be quantified as follows. For example, a sample of the conductive resin layer may be obtained from a charging member, and then, under heating the sample, a weight change obtained via thermogravimetric analysis (TG), differential thermal analysis (DTA), differential scanning calorimetry (DSC), and a mass of volatile components via mass spectrometry (MS) may be measured to quantify the particle content (TG-DTA-MS, DSC (thermal analysis)).

A shape of the particles is not particularly limited as long as a rough surface of the conductive resin layer may be formed, and examples of the shape may include a circle, an oval, or an irregular shape.

Also, any conducting agent (conductive carbon, graphite, copper, aluminum, nickel, iron, conductive tin oxide, conductive titanium oxide, or an ion conducting agent) or a charge controlling agent may be included in the base polymer in addition to the particles described above.

A 10-point average roughness (RzJIS) of a surface of the conductive resin layer may be in a range of about 10.0 μm to about 35.0 μm. When the 10-point average roughness is about 10.0 μm or greater, charging performance may be easily secured, and when the 10-point average roughness is about 35.0 μm or less, coating stability may be easily obtained. In the same regard, the 10-point average roughness may be in a range of about 12.0 μm to about 30.0 μm, or, for example, in a range of about 15.0 μm to about 25.0 μm. The 10-point average roughness of the conductive resin layer may be measured by using a surface roughness tester, SE-3400, available from Kosaka Laboratory Co., Ltd. In particular, the 10-point average roughness may be calculated by adding an absolute average value of the peak-top altitudes from the highest peak-altitude to the $5^{th}$ highest peak-altitude and an absolute average value of the valley-bottom altitudes from the lowest valley-altitude to the $5^{th}$ lowest valley-altitude, where the peak-top altitudes and the valley-bottom altitudes are obtained from a part beyond a standard length in a roughness curve obtained by using the tester.

Figure 3:
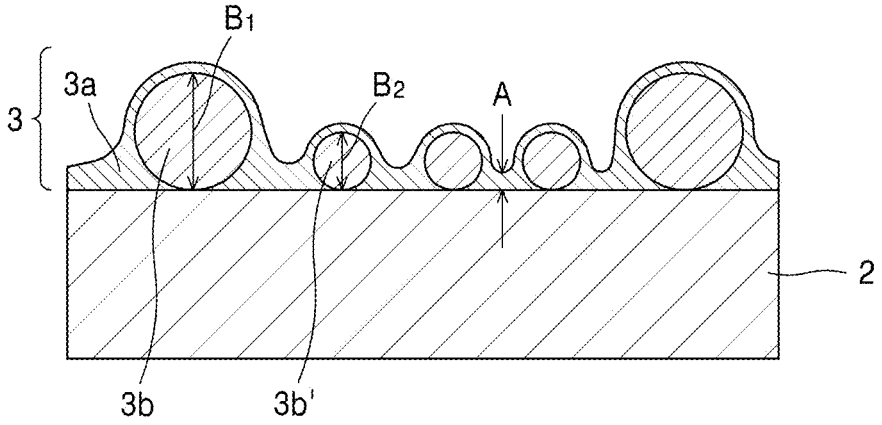
FIG. 3 is a schematic cross-sectional view of another embodiment of the charging member according to one aspect of the present disclosure.

The particles may include second particles in addition to the first particles. FIG. 3 is an enlarged schematic cross-sectional view of a surface of a conductive resin layer 3 of a charging member according to an embodiment. As shown in FIG. 3, the conductive resin layer 3 includes a matrix material 3*a* and a plurality of first particles 3*b* and second particles 3*b*', which are each at least one type selected from the group consisting of resin particles and inorganic particles, and the plurality of first particles 3*b* and second particles 3*b*' are dispersed in the matrix material 3*a*.

In this case, an average particle size of the first particles 3*b*, $B_1$, may be in a range of about 15.0 μm to about 40.0 μm, and a difference ($B_1$−$B_2$) between the average particle size of the first particles 3*b*, $B_1$, and an average particle size of the second particles 3*b*', $B_2$, may be about 10.0 μm or greater.

Also, in terms of suppressing fogging, when the second particles 3*b*' are included, $B_1$ may be in a range of about 15.0 μm to about 30.0 μm, or, for example, in a range of about 15.0 μm to about 25.0 μm. Also, in terms of suppressing charging unevenness, $B_1$-$B_2$ may be about 12.0 μm or greater, or, for example, about 15.0 μm or greater. Here, an upper limit of $B_1$-$B_2$ is not particularly limited, but may be about 35.0 μm or less in terms of improving a potential difference at a protruding end of each of the particles during discharging.

The charging member according to an embodiment may have an AskerC hardness of about 78±4. When the AskerC hardness is within this range, a contact status between the charging member and a photoconductor may be easily stabilized. In particular, when the AskerC hardness is less than about 74, a degree of deformation at a contact region between the charging member and the photoconductor increases, and a degree of permanent deformation at that region may increase. As a result, this may easily cause image defects. Also, when the AskerC hardness is greater than about 82, the charging member may not be deformed even when a load is applied thereto, and thus a good contact status between the charging member and the photoconductor may not be maintained. In this regard, the AskerC hardness may be 78±3, or, for example, 78±2.

Also, the charging member according to an embodiment may have a shape of a crown that has an external diameter at both ends smaller than that in the center in a longitudinal direction of a roller. In particular, when a load applied to an end of a conductive support (a core rod) is in a range of 5.0 N to 8.0 N, a crown amount of the charging member may be in a range of about 60 μm to about 120 μm. The center, when the crown amount is less than about 60 μm, or the ends, when the crown amount is greater than about 120 μm, may not be well contacted with a photoconductor drum, and charging may not be evenly performed. In this regard, when the load applied to the end of the conductive support is in a range of 5.0 N to 8.0 N, the crown amount may be in a range of about 70 μm to about 110 μm. Also, the crown amount of the charging member in the present embodiment is defined as follows.

$$\text{A crown amount}=D2-(D1+D3)/2$$

Figure 8:
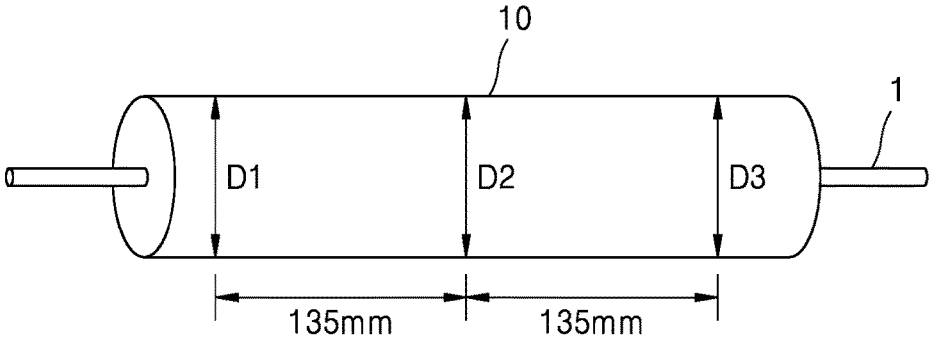
FIG. 8 illustrates diameters D1, D2, and D3 for a charging member according to the present disclosure.

(wherein, in the equation above, D1 (mm) refers to an external diameter of the charging member at one end side in a longitudinal direction, D2 (mm) refers to an external diameter of the charging member at the center, and D3 refers to an external diameter of the charging member at the other end side in the longitudinal direction. See FIG. 8 for an illustration of D1 D2 and D3. D1 and D3 are the external diameters at about 135 mm from the center in directions toward both ends, respectively.)

The charging member of the present embodiment may have a log R value of about 5.4±0.4 when an electric resistance value measured by a metal roll electrode method is referred to as R. When the log R value is within this range, the charging performance of the charging member may be easily maintained up to an endurance lifespan of the photoconductor. In particular, when the log R value is less than about 5.0, damage to a surface of the photoconductor may easily become a leak cause. Also, when the log R value is greater than about 5.8, a discharge status becomes unstable, which causes charging defects, and, as a result, may become a cause of image defects. In this regard, the log R value may be about 5.4±0.3, or, for example, about 5.4±0.2.

Only a DC voltage may be applied to the charging member of the present disclosure. The charging member of the present embodiment may have a bias voltage in a range of about −1000 V to about −1500 V, which is applied during an image printing process, until the end of the lifespan of the photoconductor. Accordingly, charging performance may be maintained under various environments, and various conditions such as image concentration may be easily controlled. In particular, when the bias voltage is lower than about −1500 V, development conditions needed for image formation may not be optimized. In particular, when the bias voltage is higher than about −1000 V, over-discharge may occur at the particles of the conductive resin layer, and thus image defects in the form of white spots after forming the image may occur.

<Preparation Method of Charging Member>

For example, the charging member 10 shown in FIG. 1 may be prepared as follows. That is, ingredients for a conductive elastomer layer are kneaded by using a kneader to prepare a material for a conductive elastomer layer. Also, the material for a conductive resin layer is kneaded by using a kneader such as a roll to prepare a mixture, and an organic solvent is added to the mixture. Then, the mixture is mixed and stirred to prepare a coating solution for a conductive resin layer. Subsequently, the material for a conductive elastomer layer is filled in a mold for injection molding, wherein the mold includes therein a core rod that becomes a conductive support, and thermal cross-linking is performed thereon under a predetermined condition. Then, the resultant is released from the mold to provide a base roll that has a conductive elastomer layer formed along an outer circumference surface of the conductive support. Thereafter, the coating solution for a conductive resin layer is applied on an outer circumference surface of the base roll to form a conductive resin layer. In this regard, a charging member includes the conductive elastomer layer that is formed on the outer circumference surface of the conductive support and the conductive resin layer that is formed on the outer circumference surface of the conductive elastomer layer.

Also, a formation method of the conductive elastomer layer is not limited to the injection molding method, and a cast molding method or a method including combination of press molding and polishing may be used. Also, a coating method of the coating solution for a conductive resin layer is not particularly limited, and any conventionally known method such as dipping, spray-coating, or roll-coating may be used.

According to another aspect of the present disclosure, an embodiment of an electrophotographic image forming device may include a main body, an image carrier, and a charging member for charging the image carrier, wherein the charging member is one of the embodiments of the charging member that is provided according to an aspect of the present disclosure.

Figure 7:
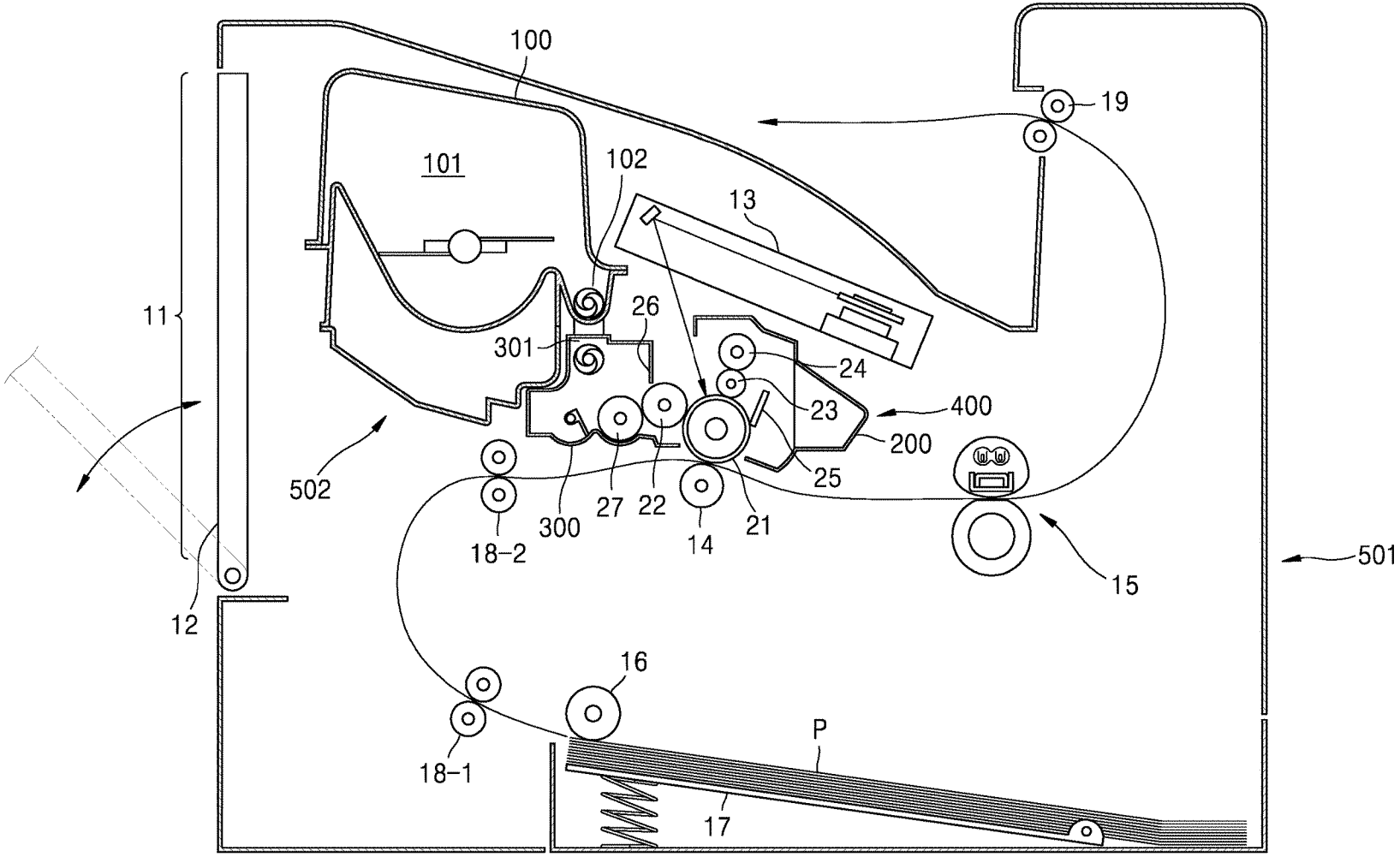
FIG. 7 is a schematic cross-sectional view of one embodiment of an electrophotographic image forming device according to another aspect of the present disclosure.

FIG. 7 is a schematic configuration of an embodiment of an electrophotographic image forming device according to another aspect of the present disclosure. The embodiment of FIG. 7 includes an image forming device main body 501, a photosensitive drum 21, which is an image carrier, and a charging roller 23, which is a charging member for charging the photosensitive drum 21. The charging roller 23 is one of the embodiments of the charging member provided according to an aspect of the present disclosure. A process cartridge 502 is also shown in FIG. 7. The main body 501 is provided with an opening 11 that provides a pathway for installing/uninstalling the process cartridge 502. A cover 12 opens and closes the opening 11. The main body 501 includes a light-exposure means 13, a transfer roller 14, and a fuser 15. Also, the main body 501 may be provided with a recording medium transfer structure, wherein the recording medium transfer structure is loaded with a recording medium P, on which an image is to be formed, and the recording medium transfer structure transfers the recording medium P. The process cartridge 502 may include a toner receiving unit 101, the photosensitive drum 21 having an electrostatic latent image on a surface thereof, and a developing roller 22 that supplies a toner received from the toner receiving unit 101 to an electrostatic latent image to develop the image into a visible toner image. The process cartridge 502 may have a first structure that includes an imaging cartridge 400 including a photosensitive drum 21 and a developing roller 22 and a toner cartridge 100 including a toner receiving unit 101, a second structure that includes a photoconductor cartridge 200 including a photosensitive drum 21, a developing cartridge 300 including a developing roller 22, and a toner cartridge 100 including a toner receiving unit 101, a third structure that includes a photoconductor cartridge 200 and a developing cartridge 300 including a toner receiving unit 101, or a fourth structure that includes a photoconductor cartridge 200, a developing cartridge 300, and a toner cartridge 100 that are integrated into one body. In the case of the process cartridge 502 having the first structure (or the second structure), once the toner cartridge 100 is mounted in the main body 501, the toner cartridge 100 is connected to an image cartridge 400 (or the developing cartridge 300). For example, once the toner cartridge 100 is mounted in the main body 501, a toner discharge unit 102 of the toner cartridge 100 and a toner inlet unit 301 of the imaging cartridge 400 (or the developing cartridge 300) are connected to each other. For example, the process cartridge 502 of the present embodiment has the first structure. Thus, the imaging cartridge 400 and the toner cartridge 100 may be independently attached to or detached from the main body 501. The process cartridge 502 is a consumable product that may be replaced when the lifespan elapses. Generally, the lifespan of the imaging cartridge 400 is longer than the lifespan of the toner cartridge 100. When a toner contained in the toner cartridge 100 is all consumed, only the toner cartridge 100 may be replaced, and thus a cost for replacing consumable products may reduce. The photoconductor cartridge 200 includes the photosensitive drum 21. The photosensitive drum 21 is an example of a photoconductor that has an electrostatic latent image on a surface thereof which may include a conductive metal pipe and a photosensitive layer that is formed on an outer circumference of the conductive metal pipe. The charging roller 23 is an example of the charing member according to an aspect of the present disclosure that charges the photosensitive drum 21 to have an even surface potential. The reference numeral 24 is a cleaing roller that removes impurities on a surface of the charging roller 23. A cleaning blade 25 is an example of a cleaning means that removes a toner and impurities remaining on a surface of the photosensitive drum 21 after a transferring process, which will be described later in the specification. Another type of a cleaning device such as a rotating brush may be used instead of the cleaning blade 25. The developing cartridge 300 supplies a toner received from the toner receiving unit 101 to an electrostatic latent image to develop the electrostatic latent image into a visible toner image. The image may be developed by using a one-component developing method that uses a toner or a two-component developing method that uses a toner and a carrier. The developing cartridge 300 of the present embodiment uses a one-component developing method. The developing roller 22 is used to supply a toner to the photosensitive drum 21. A developing bias voltage may be applied to the developing roller 22 to supply the toner to the photosensitive drum 21. The one-component developing method may be classified into a contact developing method, in which the developing roller 22 and the photosensitive drum 21 rotate in contact of each other, and a non-contact develing method, in which the developing roller 22 and the photosensitive drum 21 are spaced apart at a distance of several tens to several hundreds of microns and rotate. A regulation member 26 controls an amount of the toner being supplied by the developing roller 22 to a developing area where the photosensitive drum 21 faces the developing roller 22. The regulation member 26 may be a doctor blade that elastically contacts on a surface of the developing roller 22. A supply roller 27 supplies the toner in the process cartridge 502 to a surface of the developing roller 22. In this regard, a supply bias voltage may be applied to the supply roller 27. When the two-component developing method is used, the developing roller 22 is spaced apart from the photosensitive drum 21 at a distance of several tens to several hundreds of microns. Although not shown in the drawing, the developing roller 22 may have a magnetic roller disposed in a hallow cylindrical sleeve. The toner is adhered on a surface of a magnetic carrier. The magnetic carrier is adhered on a surface of the developing roller 22 and delivered to the developing area where the photosensitive drum 21 and the developing roller 22 face each other. Due to a developing bias voltage that is applied between the developing roller 22 and the photosensitive drum 21, only the toner is supplied to the photosensitive drum 21 and thus develops an electrostatic latent image formed on a surface of the photosensitive drum 21 into a visible toner image. The process cartridge 502 may include a stirrer (not shown) that mixes and stirs the toner with the carrier and delivers the mixture to the developing roller 22. The stirrer may be, for example, an auger, and a plurality of stirrers may be prepared in the process cartridge 502. The light-exposure means 13 irradiates light that has been modified according to image information to the photosensitive drum 21 and forms an electrostatic latent image on the photosensitive drum 21. As the light-exposure means 13, a laser scanning unit (LSU) that uses a laser diode as a light source or a light emitting diode (LED) stepper that uses an LED as a light source may be used. The transfer roller 14 is an example of a transferring device that transfers a toner image from the photosensitive drum 21 to the recording medium P. A transfer bias voltage is applied to the transfer roller 14 to transfer the toner image to the recording medium P. A transferring device such as a corona transferring device or a transferring device of a pin scorotron type may be used instead of the transfer roller 14. Each sheet of the recording medium P is picked up by a pick-up roller 16 from a loading board 17, and the sheet is transferred to an area where the photosensitive drum 21 and the transfer roller 14 face each other by using moving rollers 18-1, 18-2. The fuser 15 fuses an image transferred to the recording medium P, and fixes the transferred image to the recording medium P, by applying heat and pressure. The recording medium P passed through the fuser 15 is discharged to the outside of the main body 501 by a discharge roller 19. In the structure described above, the stepper 13 irradiates light that has been modified according to image information to the photosensitive drum 21 and forms an electrostatic latent image. The developing roller 22 supplies a toner to an electrostatic latent image to form a visible toner image on a surface of the photosensitive drum 21. The recording medium P loaded on the loading board 17 is moved to an area where the photosensitive drum 21 and the transferring roller 14 face each other by the pick-up roller 16 and the moving rollers 18-1,18-2, and a toner image is transferring onto the recording medium P from the photosensitive drum 21 by a transfer bias voltage that is applied to the transfer roller 14. When the recording medium P passes through the fuser 15, the toner image is fused to the recording medium P by heat and pressure. The recording medium P after completing the fusion is discharged by the discharge roller 19.

The embodiment shown in FIG. 7 is provided only by way of an example, and embodiments of an electrophotographic image forming device according to another aspect of the present disclosure, and a structure thereof including an image forming device main body, an image carrier, and a charging member may vary.

MODE FOR INVENTION

Example

Hereinafter, the inventive concept will be described in detail by referring to examples, but the inventive concept is not limited to the examples.

Example 1

Preparation of Material for Forming Conductive Elastomer Layer 100.00 parts by weight of epichlorohydrin rubber ("Epichlomer CG-102", available from Daiso, Japan), as a rubber component; 5.00 parts by weight of sorbitan fatty acid ester ("Splendor R-300", available from Kao Chemicals, Japan), as a lubricant; 5.00 parts by weight of ricinoleic acid, as a softener; 0.50 parts by weight of a hydrotalcite-based compound ("DHT-4A", available from Kyowa Chemical Industry, Japan), as a neutralizing agent; 1.00 part by weight of tetrabuyl ammonium chloride (an ion conducting agent, "tetrabuyl ammonium chloride", available from Tokyo Chemical, Japan); 50.00 parts by weight of silica ("Nipsil ER", available from Tosoh Silica Co. Japan), as a filler; 5.00 parts by weight of zinc oxide, 1.50 parts by weight of dibenzothiazolyl disulfide, and 0.50 parts by weight of tetramethylsilane monosulfide, as a cross-linking accelerator; and 1.05 parts by weight of sulfur, as a cross-linking agent were mixed and kneaded by using a predetermined roll to prepare a material for forming a conductive elastomer layer (a material for forming a rubber elastic part)

Preparation of Coating Solution for Forming Conductive Resin Layer 100.00 parts by weight of thermoplastic N-methoxymethylated 6-nylon ("Torejin F-30K", available from Nagase ChemteX Co., Japan), as a polymer component; 5.00 parts by weight of methylenebisethylmethylaniline ("Curehard-MED", available from Ihara Chemical Industry Co., Japan), as a curing agent; and 18.00 parts by weight of carbon black (an electronic conductor, "Denka Black HS 100", available from Denki Kagaku Kogyo, Japan) as a conducting agent were mixed in tetrahydrofuran (THF), and then, resin particles or inorganic particles further disclosed below were added thereto according to Examples and Comparative Examples, and then, the mixture was sufficiently stirred until the solution was homogenous. Then, each component was dispersed in the solution by using two rolls. Accordingly, a coating solution for forming a conductive resin layer was prepared.

Resin Particles

PMMA particles (MMA particles ("Techno polymer MBX series", available from Sekisui Chemical Co., Japan))

Nylone particles ("Orgasol series", available from Elf Atochem Japan)

Inorganic Particles

Silica particles ("Denka fused silica (DF) spheres (FB, FBX)", available from Denka, Japan)

An average particle size of each type of particles was measured as follows. That is, 100 particles were randomly selected from the group of a plurality of particles through SEM observation, and a particle size average value of the 100 particles was used as an average particle size of each type of the particles. Also, when the particles are irregular-shaped, instead of having a complete spherical shape, a simple average value of the longest diameter and the shortest diameter was used as a particle size of each of the particles.

Manufacture of Charging Member

A roll mold having a roll molding space in a shape of a cylinder was prepared, and a core rod having a diameter of 6 mm was included in a manner that the core rod was in the same axis with the roll molding space. In the roll molding space included with the core rod, the material for forming a conductive elastomer layer prepared as described above was injected, heated at 170° C. for 30 minutes, cooled, and detached from the mold. Accordingly, a conductive elastomer layer having a thickness of 3 mm was obtained along an outer circumference surface of the core rod as a conductive support.

Then, the coating solution for forming a conductive resin layer prepared as described above was applied on a surface of a roller body of the conductive elastomer layer by using a roll coating method. Here, the coating was performed while dropping an unnecessary coating solution with a scraper so that a coating layer thus formed had the desired thickness. After forming the coating layer, the resultant was heated at 150° C. for 30 minutes, and thus a conductive resin layer having a thickness of 1.0 μm was formed. Accordingly, a charging member having the conductive support, the conductive elastomer layer formed along the outer circumference surface of the conductive support, and the conductive resin layer formed along an outer circumference surface of the conductive elastomer layer was prepared. Also, a crown amount was 90 μm.

<Various Evaluation>

The charging members thus obtained were evaluated as follows. The results of the evaluation are shown in Tables 1 to 6 and Tables 7 to 9. Also, a particle added amount [phr] of Table 1 refers to an added amount (part by weight) with respect to 100 parts by weight of the matrix material (N-methoxymethylated6-nylon in the present embodiment).

a) Thickness and Interparticle Distance of Conductive Resin Layer

A thickness A of the conductive resin layer was calculated by measuring thicknesses of a plurality of points from an ×5000 magnified image observed by using a scanning electron microscope (SEM). Also, an interparticle distance Sm was measured, with a cut-off of 0.8 mm and a measurement length of 8 mm, by using a method according to JIS94-B0601 evaluation with a surface roughness tester, SE-3400, available from Kosaka Laboratory Co., Ltd., Japan. Specifically, randomly selected 6 spots of the charging member were measured by using the tester, and an average value of the 6 spots was used as a measured value for the corresponding sample.

b) 10-Point Average Roughness of Conductive Resin Layer

A 10-point average roughness (RzJIS) of the conductive resin layer was measured at a cut-off of 0.8 mm, a measurement rate of 0.5 mm/s, and a measurement length of 8 mm by using a method according to 10-point average roughness evaluation of JIS94-B0601 with a surface roughness tester, SE-3400, available from Kosaka Laboratory Co., Ltd., Japan. Specifically, randomly selected 6 spots of the charging member were measured by using the tester, and an average value of the 6 spots was used as a 10-point average roughness.

c) Image Formation Evaluation

As an image formation device, MultixpressC8640ND available from Samsung Electronics was used. The charging member obtained as described above was applied thereto, and image formation evaluation was performed according to the following conditions.

<Image Formation Condition>

Printing environment: Under room-temperature room-humidity environment (23° C./60% RH)

Printing condition: A normal printing speed of 305 mm/sec, a half-speed thereof, the number of printing sheets (180 kPV, 360 kPV 2 points), and a type of paper (Office-PaperEC)

Load toward an end of the conductive support: One-side 5.88 N

Applied bias: determined so as to appropriately controlling a photoconductor surface potential to be −600 V c-1) Roughness Evaluation A half-tone image was printed out by using the image forming device. The image was observed with the naked eyes to evaluated roughness of the image according to the following standards.

Evaluation Grade A: no rough feeling occurred on the half tone image

Evaluation Grade B: slight rough feeling occurred on the half tone image (due to minor abrasion)

Evaluation Grade C: slight rough feeling and smudge occurred on the half tone image (minor particle drop-out caused by abrasion occurred)

Evaluation Grade D: rough feeling and smudge occurred on the half tone image c-2) Initial Charging Defect Evaluation A half-tone image was printed out by using the image forming device. Initial charging defect appeared on the image was observed with the naked eyes and was evaluated according to the following standards. Also, the initial charging defect is deemed as related to: a sliding property change of the photoconductor and the charging member; micro-slip of the photoconductor and the charging member; and, particularly, particle drop-out that will be described in the specification.

Evaluation Grade A: Even half-tone image was obtained

Evaluation Grade B: Slight uneven charging occurred at an end of the image.

Evaluation Grade C: Significant uneven charging occurred at an end of the image.

Evaluation Grade D: Uneven charging occurred on the whole image.

c-3) Particle Drop-Out Evaluation

A surface of the charging member after running 360 kPV by using the image forming device was observed with an optical microscope (VC3000, available from Omron, Japan)

at a magnification of ×350 to observe a status of particle drop-out. Observation sites were maintained the same (30 mm from a rubber end of the charging member and a center of the charging member), and a particle drop-out ratio from an initial state was obtained through image analysis. A degree of the particle drop-out was evaluated according to the following standard.

Evaluation Grade A: Particle drop-out was not observed on the whole observation sites.

Evaluation Grade B: Particle drop-out was not observed in the center, but lower than 50% drop-out was observed at the end.

Evaluation Grade C: Particle drop-out was not observed in the center, but 50% to 100% drop-out was observed at the end.

Evaluation Grade D: Particle drop-out was observed on the whole observation sites.

c-4) Vcln Latitude Evaluation (Evaluation of Latitude at which Fogging and Carrier Attachment May be Suppressed)

When a surface potential of the photoconductor during application of a predetermined charging bias is referred to as VO, and a developing bias is referred to as Vdc, Vcln may be defined the same as shown in the equation below.

$$Vcln=VO-Vdc$$

Also, fogging may easily occur at a region lower than a predetermined value when a Vcln latitude exists in each of the charging members. In contrary, adhesion of the carrier on the photoconductor increases at a region higher than a predetermined value. In this regard, when a Vcln latitude is broad during the image printing process, the image printing process may be easily controlled.

Vcln latitude evaluation was performed as follows.

While a developing bias was fixed at a predetermined value, a charging bias value was varied to change Vcln.

In terms of foggin, a toner on the photoconductor was traferre to an adhesive tape (Scotch mending tape, available from 3M), and color of the tape was measured with a Macbeth reflection concentration meter (available from Macbeth). Also, Vcln(1) of the case when the measured value was higher than 0.02 was recorded.

In terms of carrier adhesion, Vcln(2) of the case when a carrier was observed after transferring a toner on the photoconductor to the adhesive tape was recorded.

A Vcln latitude was calculated from a potential width of Vcln(2) and Vcln(1) (a potential width at which foggin and carrier adhesion do not occur).

d) AskerC Hardness Evaluation

An AskerC hardness (surface hardness) of the charging member was measured at a 500 g-load condition by using an AskerC hardness meter according to a spring-type hardness test regulated by JIS K6301.

e) Electrical Resistance Value (Log R) Evaluation

Figure 4:
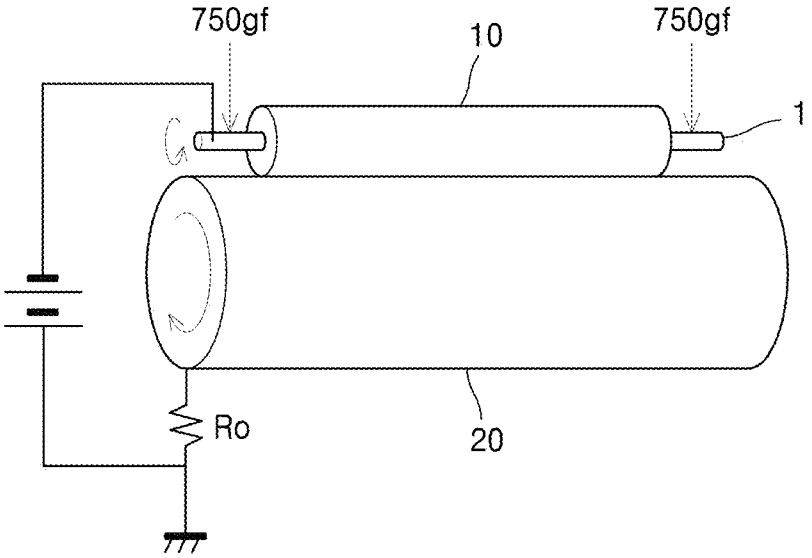
FIG. 4 illustrates a resistance value-measuring method of a charging member by using a metal roll electrode method.

FIG. 4 is a view illustrating a method of measuring electrical resistance value of a charging member 10 by a metal roll electrode method. The measurement method is as follows. First, the charging member 10 was placed to contact an aluminum cylindrical conductor 20 having a diameter of 30 mm from an upper direction in 25° C./55% RH environment. Here, the charging member 10 was pressed onto the aluminum cylindrical conductor 20 by applying a load of 750 gf on each of the two ends of the charging member (two ends of the conductive support 1). Also, an electrical resistance $R_0$ of about 1 kΩ was included at a ground side, the aluminum cylindrical conductor 20 was rotated at 60 rpm, and the charging member 10 was allowed to co-rotate with the aluminum cylindrical conductor 20. In the measurement system, a current was calculated by applying a measurement voltage −300 V to a core rod (the conductive support 1) of the charging member and measuring voltages at both ends of the resistance $R_0$ included at the ground side, and thus a resistance value R of the charging member was calculated. A log of the resistance value R was taken, and an electrical resistance value of the charging member was represented by log R.

Figure 5:
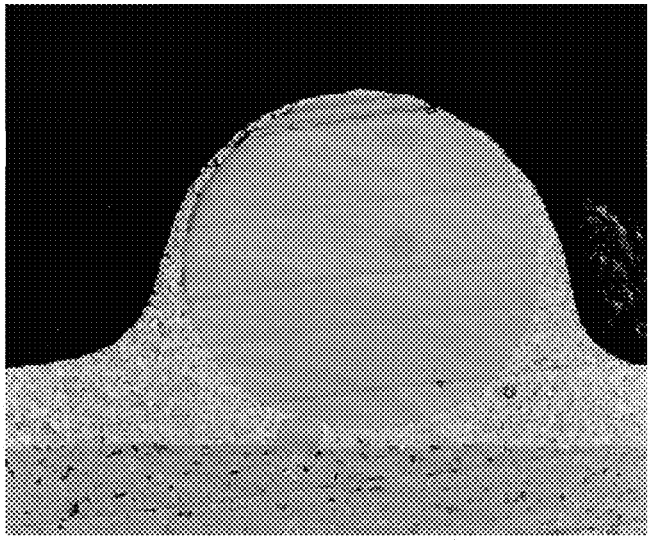
FIG. 5 is a cross-sectional scanning electron microscope (SEM) image of a surface of a conductive resin layer which has obtained an evaluation result of A (good) in the particle drop-out evaluation.
Figure 6:
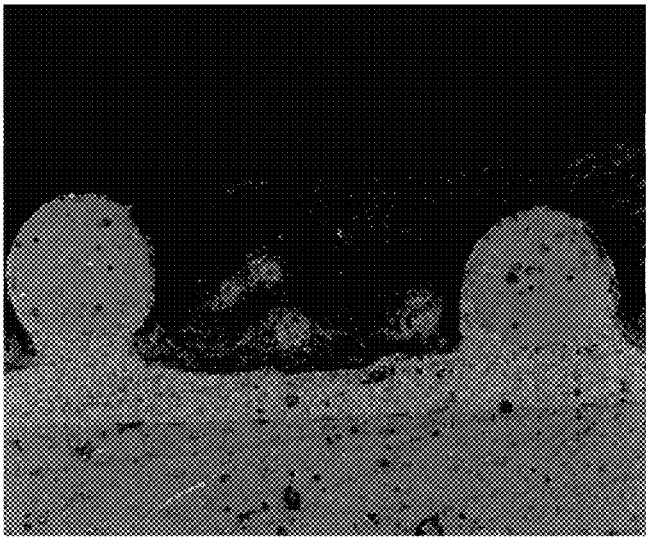
FIG. 6 is a cross-sectional SEM image of a surface of a conductive resin layer which has obtained an evaluation result of D (bad) in the particle drop-out evaluation.

Also, FIG. 5 shows a cross-sectional SEM image (magnification: ×5000) of a surface of a conductive resin layer of evaluation grade A (good) in the particle drop-out evaluation. FIG. 6 shows a cross-sectional SEM image (magnification: ×5000) of a surface of a conductive resin layer of evaluation grade D (bad) in the particle drop-out evaluation.

Examples 2 to 46 and Comparative Examples 1 to 8

Charging members were prepared in the same manner as in Example 1, except that thicknesses and types of particles of the conductive resin layer were changed as shown in Tables 1 to 6, and evaluation was performed thereon.

TABLE 1

| | Conductive resin layer | | | | | | | | | | | | |
|---|---|---|---|---|---|---|---|---|---|---|---|---|---|
| | | First particles | | | | | Second particles | | | | | | |
| | Thickness A [μm] | Particle size $B_1$ [μm] | Material | Shape | Added amount [phr] | $B_1/A$ | Particle size $B_2$ [μm] | Material | Shape | Added amount [phr] | $B_1 - B_2$ [μm] | Sm [μm] | Rz [μm] |
| Example 1 | 1.0 | 5.0 | PMMA | Spherical | 50.0 | 5.0 | — | — | — | — | — | 50 | 6.0 |
| Example 2 | 2.0 | 15.0 | PMMA | Spherical | 50.0 | 7.5 | — | — | — | — | — | 50 | 18.0 |
| Example 3 | 2.0 | 40.0 | PMMA | Spherical | 50.0 | 20.0 | — | — | — | — | — | 50 | 38.0 |
| Example 4 | 1.0 | 30.0 | PMMA | Spherical | 50.0 | 30.0 | — | — | — | — | — | 50 | 35.0 |
| Example 5 | 2.0 | 15.0 | Nylon | irregular | 45.0 | 7.5 | — | — | — | — | — | 75 | 15.0 |
| Example 6 | 2.0 | 40.0 | Nylon | irregular | 45.0 | 20.0 | — | — | — | — | — | 75 | 35.0 |
| Example 7 | 5.0 | 40.0 | Nylon | irregular | 40.0 | 8.0 | — | — | — | — | — | 100 | 33.0 |
| Example 8 | 3.0 | 35.0 | Nylon | irregular | 40.0 | 11.7 | — | — | — | — | — | 100 | 30.0 |
| Example 9 | 2.0 | 10.0 | PMMA | Spherical | 30.0 | 5.0 | — | — | — | — | — | 150 | 10.0 |
| Example 10 | 2.0 | 15.0 | Nylon | irregular | 30.0 | 7.5 | — | — | — | — | — | 150 | 12.0 |

TABLE 2

| | Conductive resin layer | | | | | | | | | | | | |
|---|---|---|---|---|---|---|---|---|---|---|---|---|---|
| | | First particles | | | | | Second particles | | | | | | |
| | Thickness A [μm] | Particle size $B_1$ [μm] | Material | Shape | Added amount [phr] | $B_1/A$ | Particle size $B_2$ [μm] | Material | Shape | Added amount [phr] | $B_1 - B_2$ [μm] | Sm [μm] | Rz [μm] |
| Example 11 | 3.0 | 25.0 | Nylon | irregular | 30.0 | 8.3 | — | — | — | — | — | 150 | 22.0 |
| Example 12 | 4.0 | 50.0 | Nylon | irregular | 30.0 | 12.5 | — | — | — | — | — | 150 | 45.0 |
| Example 13 | 2.0 | 40.0 | Nylon | irregular | 30.0 | 20.0 | — | — | — | — | — | 150 | 38.0 |
| Example 14 | 1.0 | 30.0 | PMMA | Spherical | 30.0 | 30.0 | — | — | — | — | — | 150 | 28.0 |
| Example 15 | 2.0 | 10.0 | PMMA | Spherical | 20.0 | 5.0 | — | — | — | — | — | 250 | 10.0 |
| Example 16 | 2.0 | 15.0 | Nylon | irregular | 20.0 | 7.5 | — | — | — | — | — | 250 | 13.0 |
| Example 17 | 3.0 | 25.0 | Nylon | irregular | 20.0 | 8.3 | — | — | — | — | — | 250 | 22.0 |
| Example 18 | 3.0 | 35.0 | Nylon | irregular | 20.0 | 11.7 | — | — | — | — | — | 250 | 31.0 |
| Example 19 | 2.0 | 40.0 | Nylon | irregular | 20.0 | 20.0 | — | — | — | — | — | 250 | 38.0 |
| Example 20 | 1.0 | 30.0 | PMMA | Spherical | 20.0 | 30.0 | — | — | — | — | — | 250 | 30.0 |

TABLE 3

| | Conductive resin layer | | | | | | | | | | | | |
|---|---|---|---|---|---|---|---|---|---|---|---|---|---|
| | | First particles | | | | | Second particles | | | | | | |
| | Thickness A [μm] | Particle size $B_1$ [μm] | Material | Shape | Added amount [phr] | $B_1/A$ | Particle size $B_2$ [μm] | Material | Shape | Added amount [phr] | $B_1 - B_2$ [μm] | Sm [μm] | Rz [μm] |
| Example 21 | 2.0 | 10.0 | PMMA | Spherical | 15.0 | 5.0 | — | — | — | — | — | 300 | 10.0 |
| Example 22 | 2.0 | 15.0 | Nylon | irregular | 15.0 | 7.5 | — | — | — | — | — | 300 | 13.0 |
| Example 23 | 2.0 | 40.0 | Nylon | irregular | 15.0 | 20.0 | — | — | — | — | — | 300 | 36.0 |
| Example 24 | 1.0 | 30.0 | PMMA | Spherical | 15.0 | 30.0 | — | — | — | — | — | 300 | 28.0 |
| Example 25 | 2.0 | 10.0 | PMMA | Spherical | 10.0 | 5.0 | — | — | — | — | — | 400 | 8.0 |
| Example 26 | 2.0 | 15.0 | PMMA | Spherical | 10.0 | 7.5 | — | — | — | — | — | 400 | 13.0 |
| Example 27 | 2.0 | 40.0 | PMMA | Spherical | 10.0 | 20.0 | — | — | — | — | — | 400 | 35.0 |
| Example 28 | 1.0 | 30.0 | PMMA | Spherical | 10.0 | 30.0 | — | — | — | — | — | 400 | 30.0 |
| Example 29 | 2.0 | 40.0 | PMMA | Spherical | 20.0 | 20.0 | 20.0 | PMMA | Spherical | 30.0 | 20.0 | 50 | 38.0 |
| Example 30 | 1.0 | 30.0 | PMMA | Spherical | 20.0 | 30.0 | 10.0 | PMMA | Spherical | 30.0 | 20.0 | 50 | 35.0 |

TABLE 4

| | Conductive resin layer | | | | | | | | | | | | |
|---|---|---|---|---|---|---|---|---|---|---|---|---|---|
| | | First particles | | | | | Second particles | | | | | | |
| | Thickness A [μm] | Particle size $B_1$ [μm] | Material | Shape | Added amount [phr] | $B_1/A$ | Particle size $B_2$ [μm] | Material | Shape | Added amount [phr] | $B_1 - B_2$ [μm] | Sm [μm] | Rz [μm] |
| Example 31 | 5.0 | 40.0 | Nylon | irregular | 20.0 | 8.0 | 20.0 | Nylon | irregular | 20.0 | 20.0 | 100 | 33.0 |
| Example 32 | 3.0 | 35.0 | Nylon | irregular | 15.0 | 11.7 | 10.0 | Nylon | irregular | 25.0 | 25.0 | 100 | 30.0 |
| Example 33 | 3.0 | 25.0 | Nylon | irregular | 25.0 | 8.3 | 5.0 | Nylon | irregular | 5.0 | 20.0 | 150 | 22.0 |
| Example 34 | 4.0 | 50.0 | Nylon | irregular | 10.0 | 12.5 | 30.0 | Nylon | irregular | 20.0 | 20.0 | 150 | 45.0 |
| Example 35 | 2.0 | 40.0 | Nylon | irregular | 5.0 | 20.0 | 25.0 | Nylon | irregular | 25.0 | 15.0 | 150 | 38.0 |
| Example 36 | 3.0 | 25.0 | Nylon | irregular | 15.0 | 8.3 | 10.0 | Nylon | irregular | 5.0 | 15.0 | 250 | 22.0 |
| Example 37 | 3.0 | 35.0 | Nylon | irregular | 15.0 | 11.7 | 10.0 | Nylon | irregular | 5.0 | 25.0 | 250 | 31.0 |
| Example 38 | 2.0 | 40.0 | Nylon | irregular | 15.0 | 20.0 | 20.0 | Nylon | irregular | 5.0 | 20.0 | 250 | 38.0 |
| Example 39 | 1.0 | 30.0 | PMMA | Spherical | 15.0 | 30.0 | 10.0 | Nylon | irregular | 5.0 | 20.0 | 250 | 30.0 |
| Example 40 | 2.0 | 40.0 | Nylon | irregular | 10.0 | 20.0 | 20.0 | Nylon | irregular | 5.0 | 20.0 | 300 | 36.0 |

TABLE 5

| | Conductive resin layer | | | | | | | | | | | | |
|---|---|---|---|---|---|---|---|---|---|---|---|---|---|
| | | First particles | | | | | Second particles | | | | | | |
| | Thickness A [μm] | Particle size $B_1$ [μm] | Material | Shape | Added amount [phr] | $B_1/A$ | Particle size $B_2$ [μm] | Material | Shape | Added amount [phr] | $B_1 - B_2$ [μm] | Sm [μm] | Rz [μm] |
| Example 41 | 1.0 | 30.0 | PMMA | Spherical | 10.0 | 30.0 | 15.0 | PMMA | Spherical | 5.0 | 15.0 | 300 | 28.0 |
| Example 42 | 2.0 | 40.0 | PMMA | Spherical | 5.0 | 20.0 | 5.0 | PMMA | Spherical | 5.0 | 35.0 | 400 | 35.0 |
| Example 43 | 2.0 | 15.0 | Silica | Spherical | 30.0 | 7.5 | — | — | — | — | — | 150 | 12.0 |
| Example 44 | 3.0 | 25.0 | Silica | Spherical | 30.0 | 8.3 | — | — | — | — | — | 150 | 22.0 |
| Example 45 | 4.0 | 50.0 | Silica | Spherical | 30.0 | 12.5 | — | — | — | — | — | 150 | 45.0 |
| Example 46 | 2.0 | 40.0 | Silica | Spherical | 30.0 | 20.0 | — | — | — | — | — | 150 | 38.0 |

TABLE 6

| | Conductive resin layer | | | | | | | | | | | | |
|---|---|---|---|---|---|---|---|---|---|---|---|---|---|
| | | First particles | | | | | Second particles | | | | | | |
| | Thickness A [μm] | Particle size $B_1$ [μm] | Material | Shape | Added amount [phr] | $B_1/A$ | Particle size $B_2$ [μm] | Material | Shape | Added amount [phr] | $B_1 - B_2$ [μm] | Sm [μm] | Rz [μm] |
| Comparative Example 1 | 10.0 | 30.0 | PMMA | Spherical | 60.0 | 3.0 | — | — | — | — | — | 30 | 25.0 |
| Comparative Example 2 | 0.5 | 10.0 | PMMA | Spherical | 60.0 | 20.0 | — | — | — | — | — | 30 | 8.0 |
| Comparative Example 3 | 0.5 | 20.0 | PMMA | Spherical | 60.0 | 40.0 | — | — | — | — | — | 30 | 15.0 |
| Comparative Example 4 | 10.0 | 30.0 | PMMA | Spherical | 20.0 | 3.0 | — | — | — | — | — | 250 | 20.0 |
| Comparative Example 5 | 0.5 | 20.0 | PMMA | Spherical | 20.0 | 40.0 | — | — | — | — | — | 250 | 18.0 |

TABLE 6-continued

| | Conductive resin layer | | | | | | | | | | | | |
|---|---|---|---|---|---|---|---|---|---|---|---|---|---|
| | | First particles | | | | | Second particles | | | | | | |
| | Thickness A [μm] | Particle size $B_1$ [μm] | Material | Shape | Added amount [phr] | $B_1/A$ | Particle size $B_2$ [μm] | Material | Shape | Added amount [phr] | $B_1 - B_2$ [μm] | Sm [μm] | Rz [μm] |
| Comparative Example 6 | 10.0 | 30.0 | PMMA | Spherical | 5.0 | 3.0 | — | — | — | — | — | 450 | 15.0 |
| Comparative Example 7 | 0.5 | 10.0 | PMMA | Spherical | 5.0 | 20.0 | — | — | — | — | — | 450 | 9.0 |
| Comparative Example 8 | 0.5 | 20.0 | PMMA | Spherical | 5.0 | 40.0 | — | — | — | — | — | 450 | 18.0 |

TABLE 7

| | Image formation evaluation | | | | | |
|---|---|---|---|---|---|---|
| | Roughness | Initial charging defect | Particle drop-out | Vcln latitude [V] | AskerC hardness | logR |
| Example 1 | C | C | C | 210 | 74 | 5.0 |
| Example 2 | C | A | C | 170 | 74 | 5.0 |
| Example 3 | C | A | C | 80 | 74 | 5.0 |
| Example 4 | C | A | C | 90 | 74 | 5.0 |
| Example 5 | B | B | B | 180 | 74 | 5.1 |
| Example 6 | B | A | B | 80 | 76 | 5.1 |
| Example 7 | A | A | A | 95 | 76 | 5.2 |
| Example 8 | A | A | A | 110 | 74 | 5.2 |
| Example 9 | A | B | C | 200 | 74 | 5.4 |
| Example 10 | A | A | B | 190 | 76 | 5.4 |
| Example 11 | A | A | A | 140 | 78 | 5.4 |
| Example 12 | A | A | A | 60 | 78 | 5.4 |
| Example 13 | A | A | B | 80 | 76 | 5.4 |
| Example 14 | A | A | C | 100 | 74 | 5.4 |
| Example 15 | A | B | C | 200 | 82 | 5.5 |
| Example 16 | A | A | B | 190 | 80 | 5.5 |
| Example 17 | A | A | A | 140 | 78 | 5.5 |
| Example 18 | A | A | A | 110 | 78 | 5.5 |
| Example 19 | A | A | B | 90 | 80 | 5.5 |
| Example 20 | A | A | C | 110 | 82 | 5.5 |

TABLE 8

| | Image formation evaluation | | | | | |
|---|---|---|---|---|---|---|
| | Roughness | Initial charging defect | Particle drop-out | Vcln latitude [V] | AskerC hardness | logR |
| Example 21 | A | A | C | 200 | 82 | 5.6 |
| Example 22 | A | A | B | 190 | 80 | 5.6 |
| Example 23 | A | A | B | 90 | 80 | 5.6 |
| Example 24 | A | A | C | 120 | 82 | 5.6 |
| Example 25 | A | B | C | 200 | 82 | 5.8 |
| Example 26 | A | A | C | 190 | 82 | 5.8 |
| Example 27 | A | A | C | 80 | 82 | 5.8 |
| Example 28 | A | A | C | 100 | 82 | 5.8 |
| Example 29 | A | A | A | 120 | 78 | 5.0 |
| Example 30 | A | A | B | 120 | 78 | 5.0 |
| Example 31 | A | A | A | 130 | 78 | 5.2 |
| Example 32 | A | A | A | 140 | 78 | 5.2 |
| Example 33 | A | A | A | 170 | 78 | 5.4 |
| Example 34 | A | A | A | 90 | 78 | 5.4 |
| Example 35 | A | A | A | 110 | 78 | 5.4 |
| Example 36 | A | A | A | 160 | 78 | 5.5 |
| Example 37 | A | A | A | 140 | 78 | 5.5 |
| Example 38 | A | A | A | 110 | 78 | 5.5 |
| Example 39 | A | A | A | 150 | 78 | 5.5 |
| Example 40 | A | A | A | 120 | 78 | 5.6 |

TABLE 9

| | Image formation evaluation | | | | | |
|---|---|---|---|---|---|---|
| | Roughness | Initial charging defect | Particle drop-out | Vcln latitude [V] | AskerC hardness | logR |
| Example 41 | A | A | B | 150 | 78 | 5.6 |
| Example 42 | A | A | A | 120 | 78 | 5.8 |
| Example 43 | A | A | B | 190 | 78 | 5.4 |
| Example 44 | A | A | A | 140 | 78 | 5.4 |
| Example 45 | A | A | A | 60 | 78 | 5.4 |
| Example 46 | A | A | B | 80 | 78 | 5.4 |
| Comparative Example 1 | D | D | A | 120 | 84 | 6.0 |
| Comparative Example 2 | D | D | D | 200 | 72 | 4.9 |
| Comparative Example 3 | D | D | D | 180 | 72 | 4.9 |
| Comparative Example 4 | A | D | A | 150 | 84 | 6.0 |
| Comparative Example 5 | A | D | D | 160 | 72 | 4.9 |
| Comparative Example 6 | A | D | A | 180 | 84 | 6.0 |
| Comparative Example 7 | A | D | D | 200 | 72 | 4.9 |
| Comparative Example 8 | A | D | D | 170 | 72 | 4.9 |

As described above, an image forming device including a charging member according to one or more embodiment of the inventive concept may obtain an image with sufficiently suppressed printing defects caused by roughness, initial charging defects, or particle drop-out even when the device has been driven for a long time.

While the inventive concept has been particularly shown and described with reference to exemplary embodiments thereof, it will be understood that various changes in form and details may be made therein without departing from the spirit and scope of the following claims.

INDUSTRIAL APPLICABILITY

One or more embodiments of a charging member according to an aspect of the present disclosure may be used as a charging member for charging an image carrier of an electrophotographic image forming device. One or more embodiments of an electrophotographic image forming device according to another aspect of the present disclosure may be used as an image forming device of an electrostatic latent image process type.

The invention claimed is:

1. A charging member comprising:

a conductive support;

a conductive elastomer layer stacked on the conductive support; and a conductive resin layer stacked on the conductive elastomer layer, wherein the conductive resin layer comprises:

a matrix material; and a plurality of particles dispersed in the matrix material, wherein, the plurality of particles comprise first particles, and when a thickness of a portion formed of the matrix material alone of the conductive resin layer is referred to as A [μm], an average particle size of the first particles is referred to as $B_1$ [μm], and an interparticle distance of the particles is referred to as Sm [μm], then A is in a range of 1.0 μm to 7.0 μm, $B_1/A$ is in a range of 5.0 to 30.0, and Sm is in a range of 50 μm to 400 μm.

2. The charging member of claim 1, wherein a thickness of the conductive resin layer is in a range of 1.0 μm to 5.0 μm.

3. The charging member of claim 1, wherein $B_1/A$ is in a range of 7.5 to 20.0.

4. The charging member of claim 1, wherein a 10-point average roughness (RzJIS) of the conductive resin layer is in a range of 10.0 μm to 35.0 μm.

5. The charging member of claim 1, wherein a content of the particles is in a range of 5 wt % to 50 wt % based on the total weight of the conductive resin layer.

6. The charging member of claim 1, wherein $B_1$ is in a range of 5.0 μm to 50.0 μm.

7. The charging member of claim 1, wherein the particles further comprise second particles, and when an average particle size of the second particles is referred to as $B_2$ [μm], $B_1$ is in a range of 15.0 μm to 40.0 μm, and $B_1$-$B_2$ is 10.0 μm or greater.

8. The charging member of claim 7, wherein a weight ratio of the first particles and the second particles is in a range of 5:1 to 1:5.

9. The charging member of claim 1, wherein the particles comprise insulating particles.

10. The charging member of claim 1, wherein the particles comprise irregular-shaped particles.

11. The charging member of claim 1, wherein the particles comprise resin particles.

12. The charging member of claim 11, wherein the resin particles comprise at least one type of particles selected from the group consisting of nylon resin particles and acryl resin particles.

13. The charging member of claim 1, wherein the matrix material comprises at least one type of resin selected from the group consisting of a nylon resin and a polyurethane resin.

14. The charging member of claim 1, wherein the conductive elastomer layer comprises epichlorohydrin rubber.

15. The charging member of claim 1, wherein a thickness of the conductive elastomer layer is in a range of 1.25 mm to 3.00 mm.

16. The charging member of claim 1, wherein an AskerC hardness of the charging member is 78±4.

17. The charging member of claim 1, wherein, when a load applied to an end part of the conductive support is in a range of 5.0 N to 8.0 N, the charging member has a crown amount in a range of 60 μm to 120 μm.

18. The charging member of claim 1, wherein, when an electrical resistance value of the charging member, which is measured by using a metal roll electrode method, is referred to as R, a log R value is 5.4±0.4.

19. The charging member of claim 1, to which only a direct current (DC) voltage is applied, wherein a bias voltage applied thereto is in a range of −1000 V to −1500 V.

20. An electrophotographic image forming device comprising:

a main body;

an image carrier; and a charging member for charging the image carrier, wherein the charging member is a charging member according to claim 1.

21. The charging member of claim 1, wherein A is in a range of 1.0 μm to 4.0 μm.

* * * * *